United States Patent [19]

Heffner

[11] 3,957,005

[45] May 18, 1976

[54] METHOD FOR MAKING A METAL CAN END

[75] Inventor: Robert E. Heffner, Lower Burrell, Pa.

[73] Assignee: Aluminum Company of America, Alcoa Center, Pa.

[22] Filed: June 3, 1974

[21] Appl. No.: 475,442

[52] U.S. Cl. ..... 113/1 F; 72/348; 113/121 C

[51] Int. Cl.[2] ..... B21D 51/44; B21D 22/21

[58] Field of Search ..... 113/121 C, 1 F; 220/67; 72/348

[56] References Cited

UNITED STATES PATENTS

| | | | |
|---|---|---|---|
| 343,390 | 6/1886 | Paull et al. | 72/349 |
| 3,191,422 | 6/1965 | Bolt | 72/344 |
| 3,428,010 | 2/1969 | Frankenberg | 113/120 R |
| 3,526,076 | 9/1970 | Siewerth et al. | 72/56 |
| 3,537,291 | 11/1970 | Hawkins | 72/336 |
| 3,581,456 | 6/1971 | Gere | 72/56 |
| 3,733,881 | 5/1973 | Grigorenko | 113/120 H |
| 3,768,295 | 10/1973 | Cudzik | 113/1 F |

*Primary Examiner*—C. W. Lanham
*Assistant Examiner*—E. M. Combs
*Attorney, Agent, or Firm*—Teare, Teare & Sammon

[57] ABSTRACT

A metal can end and method for making the same wherein the can end includes a body portion of substantially uniform metal thickness and a peripheral flange of reduced metal thickness to minimize the weight and quantity of material required for the can end. The can end is formed from relatively thin sheet material, such as aluminum sheet or the like, by punching or shearing a blank or disc from the sheet and forming the disc into a cup which is subjected to an ironing operation to reduce the thickness of the peripheral portion thereof and increase its projecting length. The ironed cup is then subjected to mechanical pressing, or magnetic discharge forming, to shape the peripheral portion into a curvilinear flange which is adapted to be double seamed to the can body.

22 Claims, 11 Drawing Figures

METHOD FOR MAKING A METAL CAN END

BACKGROUND OF THE INVENTION

The present invention relates to an improved can end and method for making the same, and more particularly, to a can end of the type for use with beverage cans for containing beer, soda pop or the like.

It has been known for some time that can ends for beverage cans have been stronger than required in certain areas as the metal thickness has been substantially uniform throughout with the metal thickness being determined by the anticipated load to be applied to the weakest section of the can end. For example, relatively thick metal is necessary in the central portion of the can end to give it strength and to prevent bulging when the contents of the can are sealed under pressure. On the other hand, the peripheral portions of the can end which is adapted to be double seamed onto a can do not require the same thickness of metal as is required in the central portion. Consequently, forming the entire can end to have the same thickness throughout has resulted in a substantial waste of material.

SUMMARY OF THE INVENTION

The present invention contemplates providing a new and improved can end for attachment to and closing the ends of a beverage can, such as of the type for containing beer, soda pop or the like, and a novel method for making the same. The can end of the present invention is of the type for attachment to a can body and includes a body portion and a peripheral flange portion which is adapted for attachment to the can body. The body portion has a generally uniform thickness, and the peripheral flange portion has a reduced thickness as compared to the body portion for minimizing the weight of material required for making the can end. The body portion of the unitary one-piece can is of a circular configuration with the integral peripheral flange portion of reduced metal thickness disposed outwardly and generally concentrically relative to the body portion and extending generally radially outwardly from the body portion. The peripheral flange portion may vary in thickness, being generally uniformly tapered radially outwardly in a direction away from the body portion. In a method for making the can end, a blank is formed from a sheet of material of generally uniform thickness, whereafter the peripheral flange portion of the blank is subjected to forces which act on opposite sides of the blank to reduce the thickness thereof to a thickness less than that of the original blank. More particularly, the blank is formed into a cup shape prior to having its flange portion reduced in thickness by ironing it between die parts. The ironed peripheral portion of the can end is then subjected to a shaping operation, such as a reverse drawing operation or a magnetic discharge forming operation, which forms the peripheral portion into a suitable configuration for attachment to a can body.

As can be seen from the foregoing description, a can end of optimum weight and strength is formed in a relatively simple and highly efficient manner. More particularly, the can end is formed so as to have a reduced weight resulting in the elimination of a substantial amount of unnecessary material in the end. Further, the can end can be made from a blank which is initially smaller in size in comparison to blanks that could be utilized to form can ends of the same size employing heretofore known methods, thereby effecting a substantial reduction in unnecessary material in the end. Finally, the can end is of an optimum design providing the strength necessary in certain areas as needed such that it is not overdesigned as has been the case with prior art can ends produced by prior art methods.

DESCRIPTION OF THE PREFERRED EMBODIMENTS

Figure 4:
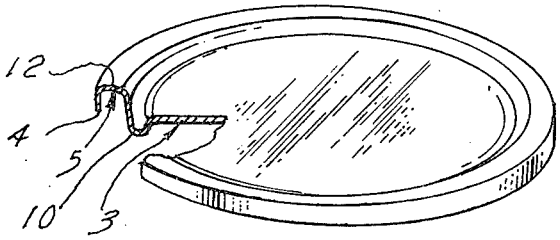
FIG. 4 is a fragmentary, partially in section, perspective view of the can end of the present invention.

Referring now to FIG. 4, a can end 1 of the present invention is illustrated which is of unitary, one-piece construction including a generally planar body portion 3 and a peripheral flange portion 5 made integral therewith and being adapted for attachment to a can such as of the type for containing beer, soda pop or the like.

The can end 1 may be of any suitable configuration, but in the form shown, the body portion 3 is generally circular in shape and the peripheral portion 5 is disposed generally concentrically thereof being defined by a generally circular peripheral edge 4. The can end 1 may be formed from a disc or shaped blank B (FIG. 5) which is punched or otherwise cut from a generally flat, sheet metal material, such as aluminum sheet material or the like, having a generally uniform thickness throughout. The peripheral portion 5 of the blank is subjected to an ironing operation during the forming process to thin the material therein to a reduced thickness in comparison with that of the body portion 3, and thereby reduce the weight of the can end 1 in the chuck wall and double seam area and enable the use of a blank of a reduced diameter to form the can end 1. The peripheral portion of the blank B is then formed into curvilinear flange portions, such as 10 and 12, which are adapted for double seaming of the can end 1 to a can body.

Figure 3:
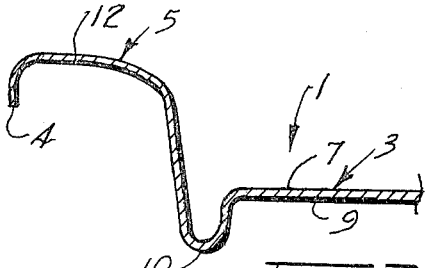
FIG. 3 is a fragmentary, transverse-sectional view of the same portion of the cup as shown in FIGS. 1 and 2 after the peripheral portion has been shaped for attachment to a can body.

As is shown in FIG. 3, an exemplary can end of this invention includes a body portion 3 having an exterior or public surface 7 which will be exteriorly exposed when the end is secured on a container and an interior or non-public surface 9. The peripheral portion 5, as formed, extends downwardly at approximately 90° to the general plane of the body portion 3, and then curves upwardly above the general plane of the body portion 3 to form an outwardly open annular groove or channel such as 10. The peripheral portion 5 then curves generally radially outwardly in a direction away from the body portion 3, and then downwardly such that it terminates above the general plane of the body portion 3 to form an outer, downwardly opening curvilinear flange, such as 12.

Figure 1:
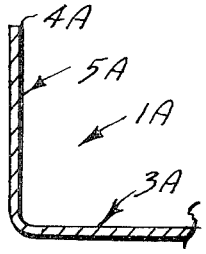
FIG. 1 is a fragmentary, transverse-sectional view through the peripheral edge portion of a sheet metal cup which is adapted to be formed into a can end.
Figure 2:
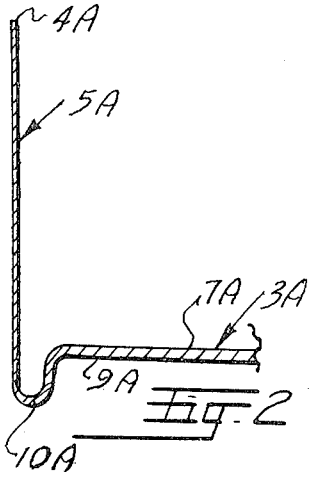
FIG. 2 is a fragmentary, transverse-sectional view of the cup as shown in FIG. 1 after the peripheral portion has been reduced in thickness in accordance with the present invention.

The can end 1 can be formed in three steps with the first step, in referring to FIG. 1, involving punching or shearing the blank B from the sheet material and drawing it into a cup as at 1A (FIG. 1) with the material adjacent the periphery, of the blank, as at 5A, drawn downwardly at 90° to the general plane of the blank to form a depending skirt around the generally planar body portion 3A of the cup 1A. The peripheray 5A of the cup 1A extends generally perpendicular to the general plane of the body portion 3A and remains of substantially the same thickness as the body portion 3A.

Figure 5:
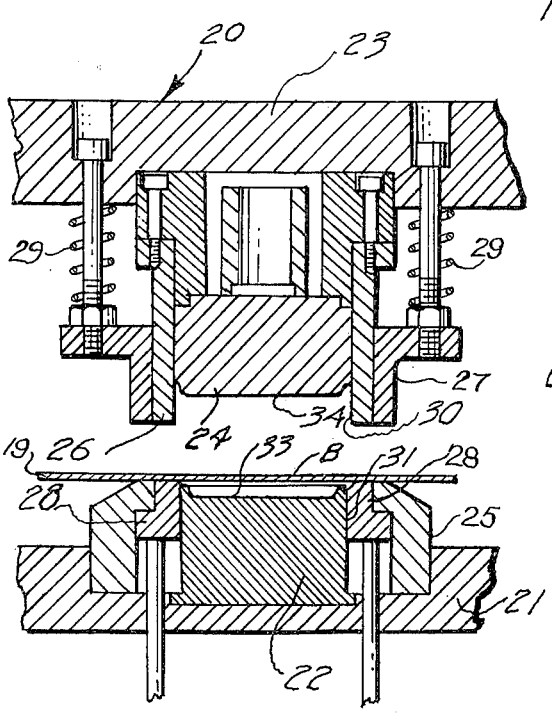
FIGS. 5 and 6 are fragmentary, partially in section views of press apparatus which is adapted to form the cup illustrated in FIG. 1.
Figure 6:
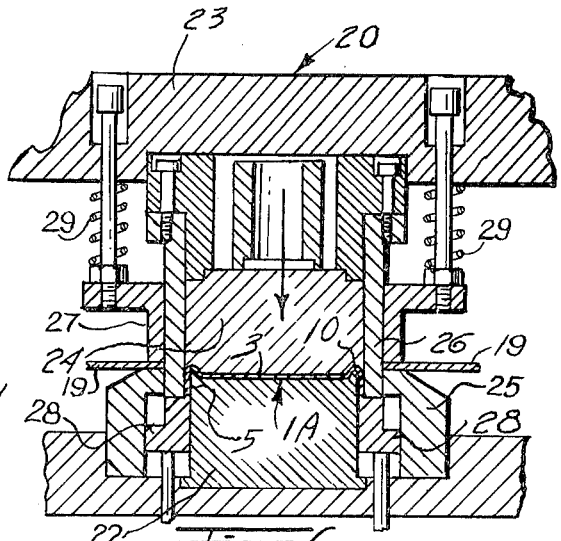

Exemplary tools for forming a blank B into a cup 1A having a depending peripheral skirt portion 5A is illustrated in FIGS. 5 and 6. The tools are mounted in a press 20 which has a lower platen 21 on which a lower die 22 is mounted, and an upper platen 23 on which an upper die 24 is mounted. A combination upper blank holder-draw ring — upper cut edge tool in the form of a collar 26 surrounds the upper die 24 and is movable, as a unit therewith. A ring 27 mounted on springs 29 is disposed around the forming collar 26 and is adapted to clamp a metal sheet 19 against a cutting ring 25 which is disposed around the lower blank holder 28. When the upper platen 23 is moved downward, blank B is sheared from the metal sheet 19 between the outer edge of the forming collar 26 and the inner edge of the cutting ring 25. The peripheral edge of the blank B is drawn inwardly from between the forming collar 26 and blank holder 28 and into an annular space between the lower die 22 and collar 26 to form a depending skirt 5 on the blank. As the upper platen 23 and dies continue downward after the blank B is formed into a cup shape 1A, the lower and upper dies 22 and 24 form the annular groove 10. In the form shown, the upper die 24 and lower die 22 are circular in outer configurations, and the forming collar 26 is of a cylindrical construction having an inner wall 30, the diameter of which is greater than the diameter of the outer wall 31, of the lower die 22, so that the upper forming collar 26 will pass downwardly over the lower die 22 along the outer wall 31. The clearance between the inner wall 30 and the outer wall 31 should be slightly greater than the thickness of the blank B such that the periphery of the blank B will be drawn downwardly between the inner wall 30 and the outer wall 31, as the upper die 24 moves over the lower die 22 and along the outer wall 31, to form the blank B into the cup 1A as shown in FIG. 6.

In FIG. 1, the cup 1A is not shown to include the annular groove 10, but if desired, such groove could be formed in a cup 1A during the first step of the forming process. For example, as shown in FIGS. 5 and 6, the lower die 22 may include a depression or cavity 33 and the upper die 24 may include a projection 34 which is complementary-shaped to the cavity 33 to either fully or partially form the groove 10 in a cup 1A as the blank B is pressed between the upper and lower die sections during the first step of the forming operation as shown in FIG. 6. On the other hand, the groove 10 may be formed during a subsequent forming step as will be shown hereinafter. Preferably, the groove 10 has approximately the same thickness as the body portion 3.

Figure 7:
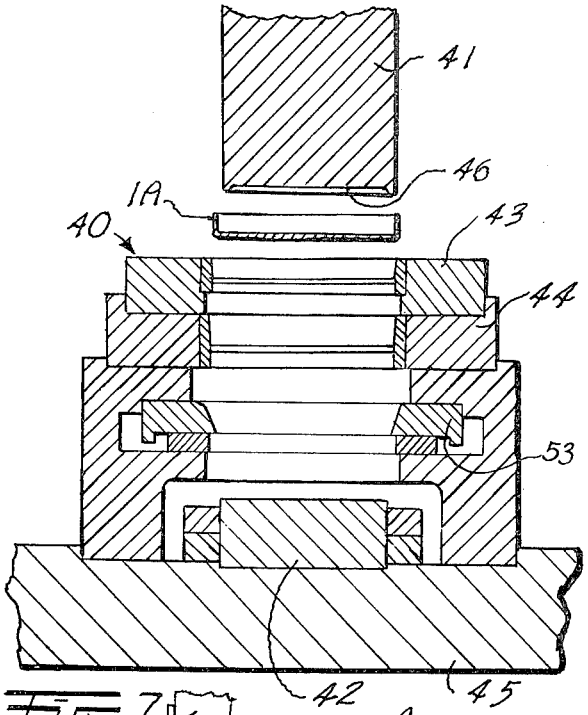
FIGS. 7 and 8 are fragmentary, partially in section views of press apparatus adapted to reduce the thickness of the cup shown in FIG. 2.
Figure 8:
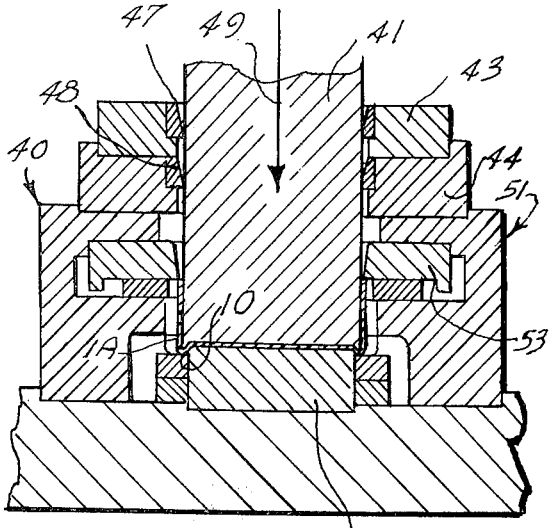

An exemplary method of performing the second step or ironing the peripheral portion 5 of the can end 1 is shown in FIGS. 7 and 8. For the purposes of illustration, the cup 1A is shown as not having an annular groove as yet formed therein. FIG. 7 shows a die assembly 40 and a movable punch or die 41 of a conventional forming press, such as a punch press or the like. As shown, the die assembly 40 is mounted in a conventional manner on the press bed 45 and includes a base 51, a lower die 42 which is axially aligned with the punch 41, and two annular ironing rings 43 and 44. The ironing rings 43 and 44 are mounted in axially aligned relation between the punch 41 and lower die 42 and are disposed and stacked in superimposed relation on the press bed 45 for receiving the punch 41 therethrough. The inside diameter of the working lands 47 and 48 on the ironing rings is a few thousandths of an inch less than the diamter of the punch 41, plus double the thickness of the skirt of the cup 1A as it enters such ring, with the bottom ring 44 having a slightly smaller inside diameter than does the ring 43. By this arrangement the cup 1A can be placed in the upper ironing die 43, being oriented in the position shown in FIG. 7, so that downward movement of the punch 41 will move the cup 1A downwardly, as indicated by the arrow 49 in FIG. 8, through the ironing rings 43 and 44 to progressively iron or reduce the thickness of the peripheral portion 5A of the cup. The die assembly 40 may include a stripper 53 for mechanically stripping the cup from the punch when the punch is withdrawn from the die assembly.

As previously stated, the annular groove 10 may be formed at the completion of the ironing step, and more particularly, may be formed at the end of the stroke of the punch 41. As shown in FIG. 7, the punch 41 may include a depression or cavity 46 which is sized to receive the upper end of the lower die 42 at the end of the stroke of the punch 41 causing the material of the cup 1A which is spaced radially inwardly from the peripheral portion 5 to be forced into the cavity 46 for either fully or partially forming the annular groove 10, as shown in FIG. 8.

Figure 10:
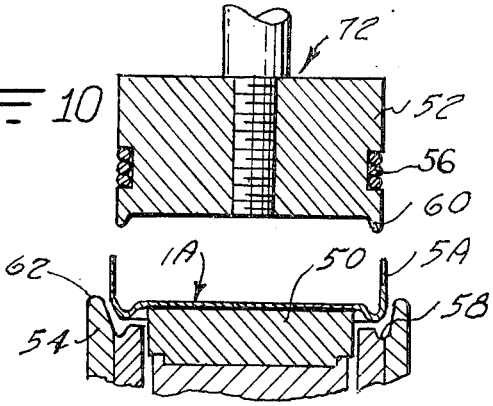
FIGS. 10 and 11 are fragmentary, partially in section views of alternative apparatus for shaping the peripheral portion of the can end for attachment to a can body.
Figure 11:
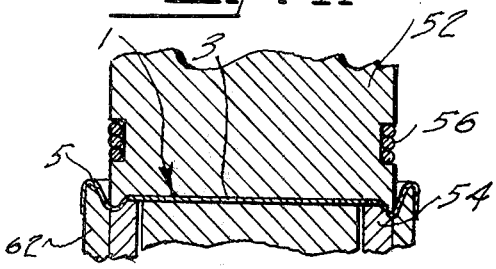

After the ironing operation, the cup 1A is next subjected to a third forming step for forming the outer curvilinear flange 12. A suggested method for forming the outer flange is shown in FIG. 10. In this step, the cup 1A is subjected to a magnetic discharge forming operation which is well known in the art. As shown, the cup 1A is supported on a holder 50 of a forming press, and is positioned in axial alignment between an upper die 52 and a lower die 54. The holder 50 may be supported in any conventional manner, such as by springs (not shown) on the press bed so as to enable it to be moved downwardly through the lower die 54. An electrically conductive helical winding 56 on the upper die 52 which is connected to a suitable source of electrical energy produces a magnetic field about the upper die 52. The magnitude of the magnetic field will be determined by the size and shape of the part to be formed. As shown, the lower die 54 includes an annular recess 58, and the upper die 52 includes a generally complementary-shaped, downwardly-depending annular rim 60. The recess 58 and rim 60 are shaped to the desired configuration for the annular groove 10. As shown, the lower die 54 includes an annular rim 62 which is shaped to the desired configuration for the curvilinear flange 12 which is to be formed. In operation of this apparatus, the upper die 52 is moved downwardly into engagement with the cup 1A and presses it into the lower die 54 thus seating the annular groove 10 in recess 58 in the lower die. At the end of the downward stroke, as shown in FIG. 11, an electrical current is applied to the helical winding 56 setting up a magnetic field about the upper die 52 and inducing an electromotive force in the work piece causing an induced current to flow therein. The inter-action of the induced current and the magnetic field create a force which in turn forces the periphery 5A of the cup 1A outwardly causing it to be wrapped about the rim 62 and conform to its configuration for forming the outer curvilinear flange 12 and complete the forming of the peripheral portions of the can end 1.

Figure 9:
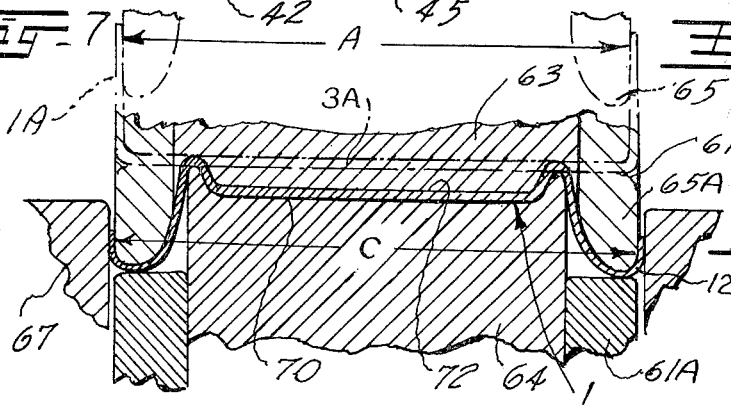
FIG. 9 is a fragmentary, partially in section view of press apparatus which is adapted to shape the peripheral portion of the can end for attachment to a can body.

An alternative method of performing the third step for forming the curvilinear flange in the peripheral portion 5 of the end cap 1 is shown in FIG. 9. In this method, the cup 1A is subjected to a reverse draw such that the finished diameter of the end cap 1 is substantially equal to that of the cup 1A prior to the reverse drawing operation. For example, the diameter, such as the distance A, of the cup 1A is equal to the diameter, such as the distance C, of the finished can end 1. In this method, the cup 1A may be supported in a press on a conventional holder, such as at 61 (dotted line position) in axial alignment with an upper die 63 and a lower die 64. An upper annular die 65 encircles the upper die 63 and is movable from an upper position, shown in dotted line at 65, to a lower forming position, shown by the solid lines at 65A. A lower annular die 67 is supported by the press in encircling relation to the lower die 64 and the holder which is shown in solid line position at 61A. The lower annular die 67 is fixedly mounted with respect to the lower die 64, and the holder 61 is movable relative to both the lower die 64 and the lower annular die 67 being supported in any suitable manner such as by springs or the like. The upper die 63 may include an annular embossment 72 and the lower die 64 may include a complementary-shaped recess 70 for receiving the embossment 72 therein at the end of the downward stroke of the upper die 63. In the form shown, the upper die 63 is moved downwardly and presses the body portion 3A of the cup 1A against the lower die 64 to partially form the curvature of the annular groove 10. With the upper die 63 pressing against the lower die 64, the upper annular die 65 may then be moved downwardly between the lower annular die 67 and the lower die 64 and force the material of the cup 1A downwardly therebetween to form the remainder of the annular groove 10 and the entire curvilinear flange 12.

As shown, both the reverse drawing operation and the magnetic discharge forming operation result in part of the non-reduced material forming part of the peripheral portion 5 such that the peripheral portion varies progressively in thickness in a direction away from the body portion 3 toward the peripheral edge 4 as shown in FIG. 3. More particularly, it is understood that the ironing and shaping operations may be performed such that the thickness of the peripheral portion 5 is uniformly reduced or progressively tapered in a direction from the convolution 10 toward the peripheral edge 4.

EXAMPLE I

An examplary can end which is formed in accordance with the present invention from aluminum sheet material 0.014 inch in thickness has the following dimensions:

| | |
|---|---|
| Original thickness of Blank B | .014" ± .0005" |
| Original diameter of Blank B | 3.177" ± .001" |
| Thickness of the body portion 3A | .014" ± .0005" |
| Thickness of the periphery 5A | .014" ± .0005" |
| Thickness of the body portion 3A as finished | .014" ± .0005" |
| Thickness of the first convolution 10 at mid-point, as finished | .014" ± .0005" |
| Thickness of the second convolution 12 at mid-point, as finished | .011" to.0085" |
| Thickness of the peripheral edge 4, as finished | .011" to.0085" |
| Final diameter of the body portion 3 as finished | 2.240" dia.± .001" |

Although a preferred embodiment of a can end, and preferred method and apparatus for forming the same have been illustrated and described herein, it will be apparent to those skilled in the art that numerous modifications can be made therein without departing from the invention or the scope of the claims appended hereto.

I claim:

1. A method for making a can end for attachment to a can body, comprising forming a blank defined by a continuous peripheral edge from a sheet of metal material of generally uniform thickness, forming said blank with predetermined initial transverse dimensions less than required to form a can end having a predetermined final configuration and based upon the final transverse dimensions of the can end, subjecting an annular peripheral portion of said blank to a thickness reducing operation until the thickness of said peripheral portion is reduced as compared to the initial thickness of said blank and the transverse dimensions of said blank are increased to substantially the size required to form said predetermined final configuration having said final transverse dimensions, and reshaping said peripheral portion to said final configuration to adapt said can end for attachment to said can body.

2. A method according to claim 1, including forming said blank into a cup by turning up said peripheral portion to form a generally planar body portion radially inwardly of said peripheral portion.

3. A method according to claim 1, including reducing the thickness of said peripheral portion by progressively reducing the thickness in a direction radially outwardly toward said peripheral edge.

4. A method according to claim 1, including reducing the thickness of said peripheral portion to said peripheral edge.

5. A method according to claim 2, including forming an annular groove in said cup adjacent to said body portion so as to progressively reduce the thickness of said peripheral portion in a direction radially outwardly toward said peripheral edge.

6. A method according to claim 5, including forming said groove partially from said body portion and partially from said peripheral portion.

7. A method according to claim 5, including forming said groove simultaneously with forming said blank into said cup.

8. A method according to claim 5, including forming said groove after forming said blank into said cup.

9. A method according to claim 5, including forming said groove after reducing the thickness of said peripheral portion.

10. A method according to claim 1, including reshaping said blank by forming convolutions in said peripheral portion so as to enable the making of an overlap seam for attachment of said can end to said can body.

11. A method according to claim 10, including forming said convolutions by forming an annular groove partially from said body portion and partially from said peripheral portion which opens outwardly to one side of said can end so that the thickness of said end is progressively reduced toward said peripheral edge.

12. A method according to claim 11, including forming said convolutions by forming a curvalinear flange radially outwardly from said groove, and forming said groove with a thickness at its mid-point greater than the thickness of said curvalinear flange at its midpoint.

13. A method according to claim 2, including subjecting said peripheral portion to an ironing operation to reduce the thickness thereof.

14. A method according to claim 10, including forming said blank in a generally circular-shaped configuration having a predetermined initial diameter based on the final diameter of said can end after being formed to said predetermined final configuration to produce a can end having less overall weight and less weight in the area of said overlap seam as compared to a can end made from a blank initially being of the same uniform thickness and initially having a diameter of the size required to form said final configuration.

15. A method according to claim 11, including progressively reducing the thickness of said peripheral portion by uniformly tapering said peripheral portion radially outwardly from said groove.

16. A method according to claim 1, including reshaping said peripheral portion by a magnetic discharge operation.

17. A method according to claim 1, including reshaping said peripheral portion by a reverse drawing operation.

18. A method according to claim 2, including forming said blank into said cup prior to reducing the thickness of said peripheral portion.

19. A method according to claim 1, including cutting said blank from said sheet material, and performing the steps of cutting, reducing and shaping in a single stroke of a die.

20. A method according to claim 19, including forming said blank into a cup prior to reducing the thickness of said peripheral portion, and performing the steps of cutting, forming the cup, reducing and shaping in a single stroke of a die.

21. A method for making a can end for attachment to a can body, comprising forming a disc-shape blank having a continuous peripheral edge from a sheet of metal material of generally uniform thickness, forming said blank with predetermined initial transverse dimensions less than required to form a can end having a predetermined final configuration and based on the final transverse dimension of the can end, forming said blank into a cup by turning up the material of said blank inwardly from said peripheral edge so as to have a generally planar body portion and an upturned peripheral portion, subjecting said peripheral portion to a thickness reducing operation until the thickness of said peripheral portion to said peripheral edge is reduced as compared to the initial thickness of said blank and the transverse dimensions are increased to substantially the size required to form said predetermined final configuration, and reshaping said peripheral portion to said final configuration to adapt said can end for attachment to said can body.

22. A method of making a can end for attachment to a can body by an overlap seam connection, comprising forming a generally circular-shaped blank having a generally circular peripheral edge from a sheet of metal material of generally uniform thickness, forming said blank with a predetermined initial diameter based on the required final diameter of said can end after being formed into a predetermined final configuration, forming said blank into a cup by turning up the material of said blank inwardly from said peripheral edge so as to have a generally planar body portion and an upturned peripheral portion initially having radial dimensions less than required to form a can end of said final configuration having said final diameter, subjecting said peripheral portion to a thickness reducing operation until the thickness of said peripheral portion to said peripheral edge is reduced as compared to the initial thickness of said blank and the radial dimensions are increased to substantially the exact size required to form said predetermined final configuration, reshaping said blank by forming an annular groove partially in said body portion and partially in said peripheral portion and opening outwardly to one side of said can end so that said can end is progressively reduced in thickness in a radial direction toward said peripheral edge, and reshaping said peripheral edge further to form a curvalinear flange radially outwardly from said groove and adapted for forming an overlap seam for connection to a can body for producing a can end having reduced overall weight and reduced weight in the area of the overlap seam as compared to a can end made from a blank initially being of the same uniform thickness initially having a diameter of the size required to form a can end of said final configuration having said final diameter.

* * * * *